United States Patent [19]

Peavey

[11] 4,290,336

[45] Sep. 22, 1981

[54] MOLDED GUITAR STRUCTURE AND METHOD OF MAKING SAME

[76] Inventor: Hartley D. Peavey, Peavey Electronics Corp., P.O. Box 2898, Meridian, Miss. 39301

[21] Appl. No.: 24,529

[22] Filed: Mar. 28, 1979

[51] Int. Cl.[3] ..... G10D 1/08; G10D 3/00

[52] U.S. Cl. ..... 84/291; 84/293; 84/314 R

[58] Field of Search ..... 84/291, 267, 293, 294

[56] References Cited

U.S. PATENT DOCUMENTS

| | | | |
|---|---|---|---|
| Re. 23,620 | 2/1953 | Finder | 84/291 |
| 3,427,915 | 2/1969 | Mooney | 84/291 X |
| 3,691,285 | 9/1972 | Larrison | 84/293 X |
| 4,088,050 | 5/1978 | Appel | 84/267 |
| 4,090,427 | 5/1978 | Kaman | 84/291 |
| 4,119,009 | 10/1978 | Kaman | 84/293 |
| 4,185,534 | 1/1980 | Cove | 84/291 |

FOREIGN PATENT DOCUMENTS

| | | | |
|---|---|---|---|
| 697869 | 11/1964 | Canada | 84/291 |

*Primary Examiner*—Lawrence R. Franklin
*Attorney, Agent, or Firm*—Victor J. Evans & Co.

[57] ABSTRACT

Disclosed herein is a guitar neck and body made from moldable materials such that the finished guitar may be made either solid, semi-solid, or substantially hollow, and wherein the structure further includes interconnection areas between the various components to provide a finished article which can be durable, require less manufacturing processes, while simultaneously providing performance characteristics at least comparable to conventional designs for guitars.

13 Claims, 17 Drawing Figures

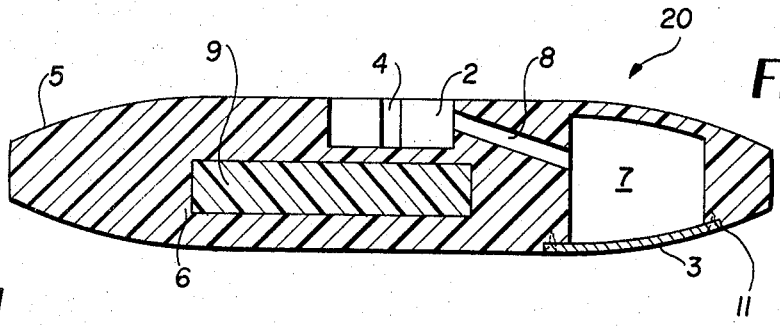
FIG. 2
FIG. 1
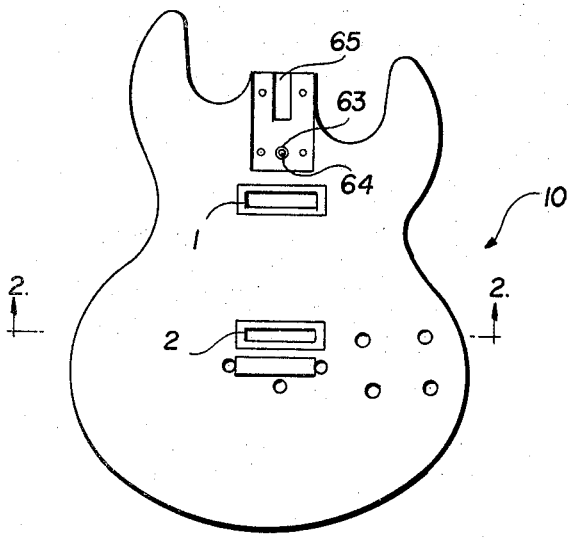
FIG. 3
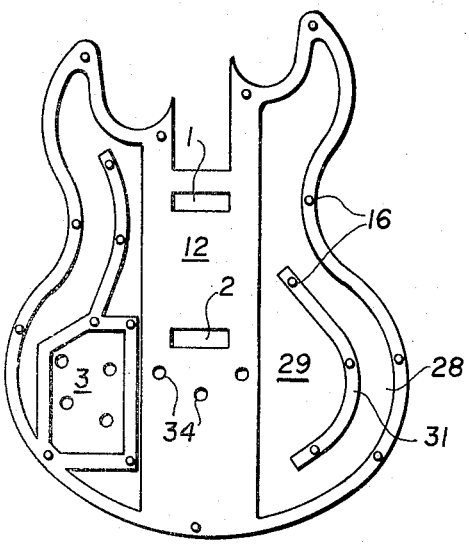
FIG. 4
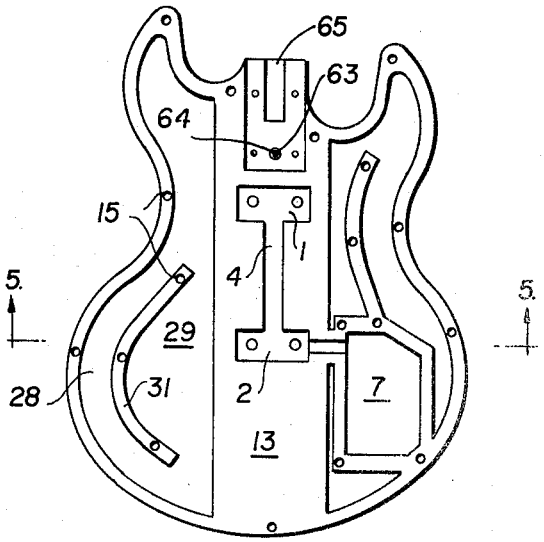

MOLDED GUITAR STRUCTURE AND METHOD OF MAKING SAME

BACKGROUND OF THE INVENTION

The state of the art for guitars formed of a solid body or semi-solid body can be characterized in that they generally require the use of expensive wood as the stock material, which has to be sized as by kiln drying. Appropriate sized blocks or blanks thereafter are glued into the approximate external configuration of the finished article, and thereafter machined on the outer faces thereof to provide the compound curves and various recesses or pockets as required to house the electronics associated therewith. Further however the use of materials compatible with the parameters associated with minimizing unwanted resonances (and therefore feedback) have generally dictated which materials are compatible. Further, imperfections in the wood, as well as the inordinate amount of time in finishing the exterior of such a guitar has resulted in intensive labor and a relatively high and needless rejection rate of blanks and stock articles so used.

OBJECTS AND SUMMARY OF THE INVENTION

Accordingly, the present invention contemplates and provides as an objective a unique guitar construction in which the resonance of the guitar body can be controlled by the specific density of foamed portions within the guitar thereby altering the guitars properties when contrasted with the prior art.

A further object has as its purpose providing a guitar thus formed which requires a minimal amount of finishing when contrasted with the prior art so as to provide a guitar having a pleasing external configuration and excellent performance.

When considering that a solid body guitar traditionally made of wood requires a tremendous amount of energy utilized in the milling, routing, sanding and painting of the finished article, it should be apparent that a guitar body fabricated from a synthetic material which can substantially be assembled on a one shot procedure having a finished external configuration would provide therefore a considerable savings, especially since such a novel construction provides a body which can control the resonance and therefore vary the response as a function of the foam density and internal configuration so defined.

One form of the invention which provides this flexibility includes a clam shell type of construction with various compartments within the clam shell capable of being filled with foams of varying density or left hollow to provide channelways for electrical apparatus, along with a molding for the seam associated with the clam shell that provides a decorative and aesthetically pleasing external configuration. This molding also serves to interconnect opposed faces of the shell.

Another form of the invention and object thereof contemplates providing a guitar body formed of foam, plastic or similar material which is fabricated by the utilization of a multi-component foam system wherein when the components are mixed the chemical reaction that occurs is exothermic so as to simultaneously provide a proper temperature for the curing of the foam thus formed. The degree of heat associated with this reaction can be controlled by the surface temperature of the mold cavity, as well as providing a core or substrate within the guitar body proper which serves as a heat sink so that the magnitude of this core or substrate can accurately alter the degree of heat absorption thereby providing a guitar body which in cross section would show a foam structure having different cure rates which result in different properties in the foam as it extends from the outer skin inwardly to the core. Such a process is defined as a reaction injection molding.

A further object contemplates providing an injectable foam guitar body which does not utilize an exothermic reaction when foam gradients are not an important design criteria.

In accordance with the molded guitar body, also provided herein and defined as an object of this invention is to provide a guitar neck constructed in a novel manner and defining a concomitant novel structure providing benefits not contemplated by the prior art.

One object and benefit contemplated by this invention includes a molded plastic guitar finger board preferably mated to a molded, glass filled polycarbonate neck. Whereas most finger boards have traditionally been made from rosewood or ebony because of the resiliency, acid resistance, and wearing characteristics, the use of synthetic materials is viewed as providing a material which not only can duplicate these physical properties, but also can lend itself to defining a structure for the guitar neck which is far more easy to fabricate than the prior art suggests. Accordingly, the structure defining the guitar neck provides an invention which drastically reduces and simplifies the production of the article and its assembly.

Similarily, associated with the guitar body and neck, the areas of interconnection or neck mounting area on the guitar body defines a structure which reliably and securely interconnects these two components, and provides a structure which advantageously benefits from the properties selected in the materials of these two previous components.

These and other objects will be made manifest when considering the ensuing detailed drawings and specification.

BRIEF DESCRIPTION OF THE DRAWINGS

FIG. 1 details a top plan view of the guitar formed according to the present invention;

FIG. 2 is a sectional view taken along lines 2—2 of FIG. 1;

FIG. 3 details a second form of the invention illustrating the top half of a clam shell type guitar;

FIG. 4 details the bottom half thereof;

BRIEF DESCRIPTION OF THE PREFERRED EMBODIMENT

Figure 5:
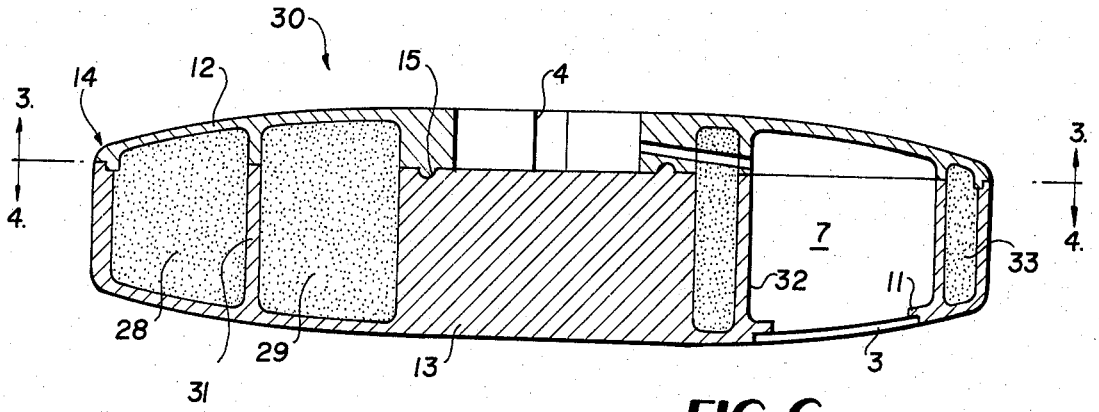
FIG. 5 is a sectional view taken along lines 5—5 of FIG. 4.
Figure 6:
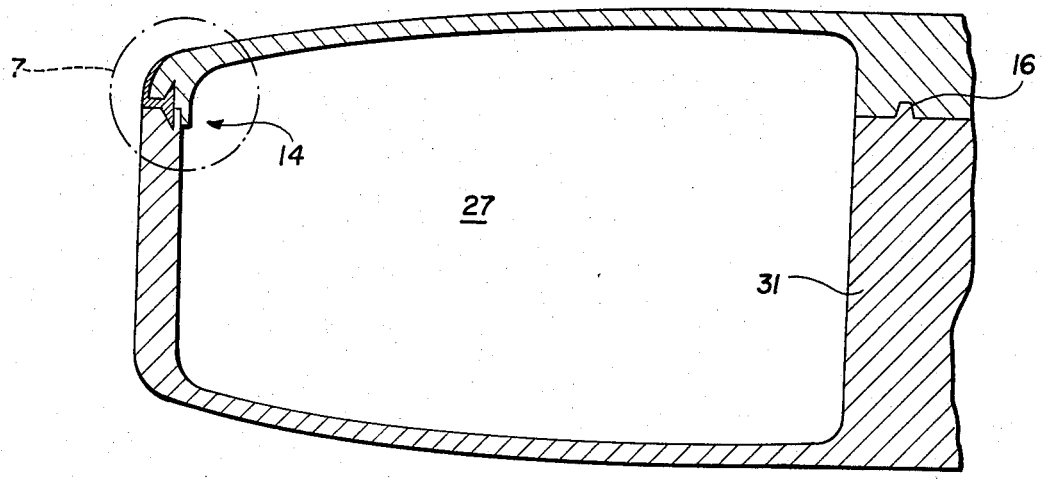
FIG. 6 details the specific structure of one end of the guitar shown in FIGS. 3 through 5.
Figure 7:
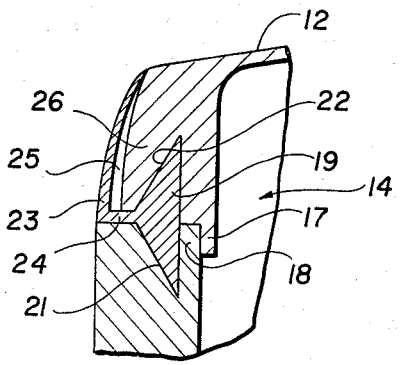
FIG. 7 specifies a molding bead which conceals the seam between the two halves of the clam shell and fastens and affixes the two together.

Referring to the drawings now, wherein like reference numerals refer to like parts throughout the several drawings, reference numeral 10 is directed to the guitar body in one form of the present invention.

This guitar body when taken in section as shown in FIG. 2 defines a core 9 preferably made of non finished wood, lathing, fiber board, or similar material, and the purpose thereof will be described shortly. However, the major portion of the guitar is provided with a foam 6 having a density which is variable as a function of the foam components used when injecting same within a mold cavity. The foam may have air or gas entrained therein as prescribed by the foam process used, and therefore the resonance associated with the guitar body of this type can be infinitely varied. The skin 5 is preferably formed from the same material as the foam 6, but its external configuration will appear somewhat differently since injection into a mold cavity will tend to cause the outer periphery to come in contact with a mold having a temperature differential relative to the exothermic reaction of the foam thus injected so as to provide a skin having a physical characteristic substantially different from that which the interior foam defines. For example, the coloring and composition of the foam can be selected such that the exterior provides a simulated wood color, and therefore an appropriate pattern configuration of the inner face of the molded cavity can similarily provide a contour corresponding to grain which can be highlighted by the external treatment of the skin with grain accentuating dyes etc. In order to control the degree of heat associated with an exothermic reaction of the type thus described, cores 9 having different configurations and different degrees of heat absorption can be selected so as to keep the foam injected therein within temperature constraints since extremely high temperatures can cause the foam to break down and not provide the requisite density, and in extreme examples can provide foam at the center of the body which remains somewhat viscous and never properly sets up without the use of the core. It should be apparent therefore that the foam will exhibit a density gradient as a function of the mold cavity temperature and the configuration as well as the material selected for the core whereby the outer periphery of the foam of the skin 5 will have one configuration and the density of the foam as it nears the core will have a dissimilar density. Cavities are formed integral with the mold so as to provide channels for the insertion therein of pick up elements proximate to recess 2 and 1, and associated wiring communicates between these two recesses through channels 4 and thereafter through channel 8 into the control pocket 7 which is provided with a control pocket cover 3. This provides a nesting area for the electronics associated therewith, as well as a place to dispose the control knobs thereon to attenuate and modify the guitar sounds. It is apparent therefore that judicious selection of the core, the foam components, and the selection of an appropriate mold cavity temperature can alter the foam density, the foam density gradient as it extends from the skin to the core, so as to provide a guitar in which resonance and therefore interference such as feedback can be controlled. As shown in FIG. 2, threaded slugs 11 or inserts may be cast into the material during the molding process so as to provide retention means for the cover plates 3 or the area of interconnection between the guitar body and the neck.

FIGS. 3 through 7 detail a second form of the invention which can be contrasted from that which is depicted in FIG. 2 by noting that whereas the foam in FIG. 2 may of may not be exothermic when mixed together, the use of an exothermic foaming process is obviated by adopting the structure of FIGS. 3 through 7, and therefore the guitar body may be fashioned as by injection or alternatively by stamp forming (non foam) plastic molding.

The structure of FIG. 3 through 7 detail a guitar shell conveniently described as of clam shell configuration having a top section 12 and a bottom section 13 of any suitable plastic material. The top portion and bottom portion are united along the outer periphery of the shell, and to this end guide means such as pins 15 and channel ways 16 are provided and the length and width of these guides are variable. The top and bottom sections are interconnected by a main central core which underlies both pickup areas 1 and 2 as well as channels 4 and 8. The outer edges or portions of the guitar are provided with structural support by means of ribs 31, 32 which interconnect the top and bottom portions and the outer edge thereof of the guitar, and these upstanding ribs are similarily fastened between the top and bottom sections by means of channels and pins. The seam which extends around the outer periphery of the guitar body when using the clam shell type configuration, benefits from a trimming molding 14 that serves the dual purpose of ornamentation and protection of the vulnerable edges of the instrument. The seam between the top and bottom portions is effectively hidden by means of this molding which may be considered as having a T-shaped configuration and can be made from any suitable semiridged plastic material or the like characterized in its having a memory so that its original shape will be preserved and also will continue to urge the top and bottom portions into continuous engagement by providing tension thereon. A suitable material for example could be butyrate, but other synthetic materials would be similarily suitable. The molding 14 is defined by a downwardly curved strip 23 which extends from a top edge of the top section of the shell 12 and thereafter extends in a substantially horizontal direction 24 (FIG. 7) and finally thereafter to form a triangular edge 19 in which the specifics of the structure will now be appreciated when considered with the additional seam structure. The inwardly extending stem portion 24 depending from strip 23 and the triangular shaped wedge 19 coact against recesses having complimental configurations 21 and 22 in the lower and upper halves respectively. The top section preferably is provided with a downwardly extending lip 17 which overlies a terminal portion of the bottom half 18 and that terminal portion causes the wedge or triangle 19 to tightly coact thereagainst. In use and operation, the material forming this molding will naturally tend to rest in this appropriate cut away area and an adhesive or solvent which causes a chemical reaction between the upper and lower sections and the molding can be used to effect a tight seal therebetween, effectively shielding the seam from unwanted stresses and also making same concealed. The molding of course can have an ornamental configuration which is aesthetically pleasing. The aligning studs and grooves serve to assist the ease of assembly. When assembled, the visible binding or molding would be in tension against the body halves.

The various cavities 28, 29, 33 etc. may or may not be provided with foam therein, and the density of the foam may be altered so as to provide a flexibility in determining resonance capabilities of the guitar so constructed.

The structure according to this embodiment of course lends itself quite well to a cold injection process, or alternatively a stamping process in which the molding occurs simultaneously with the structure forming. The top and bottom views of FIGS. 3 and 4 show that the ribs 31, 32 etc. have a generally wall like configuration and may be arcuate or linear. The holes 34 (FIG. 3) denote areas for mounting the bridge of the guitar thereon.

Figure 8:
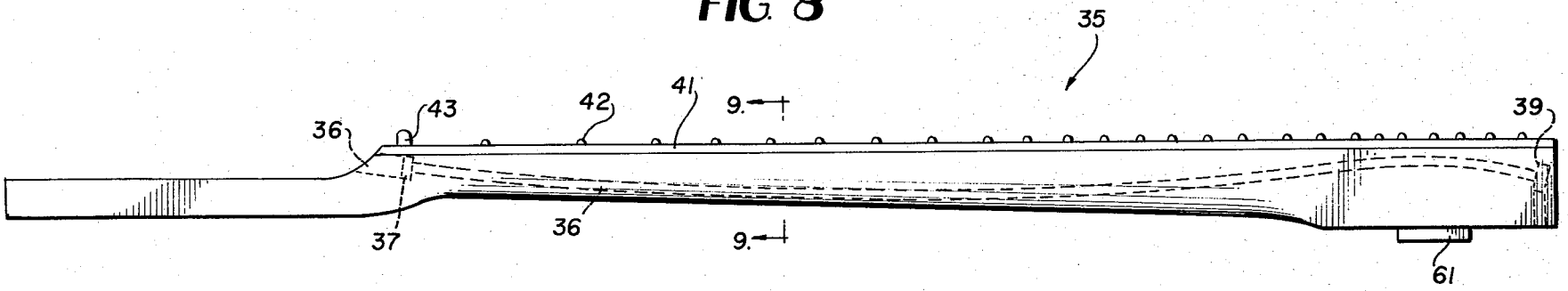
FIG. 8 shows a side view of the guitar neck and a torsion bar associated therewith in phantom.
Figure 10:
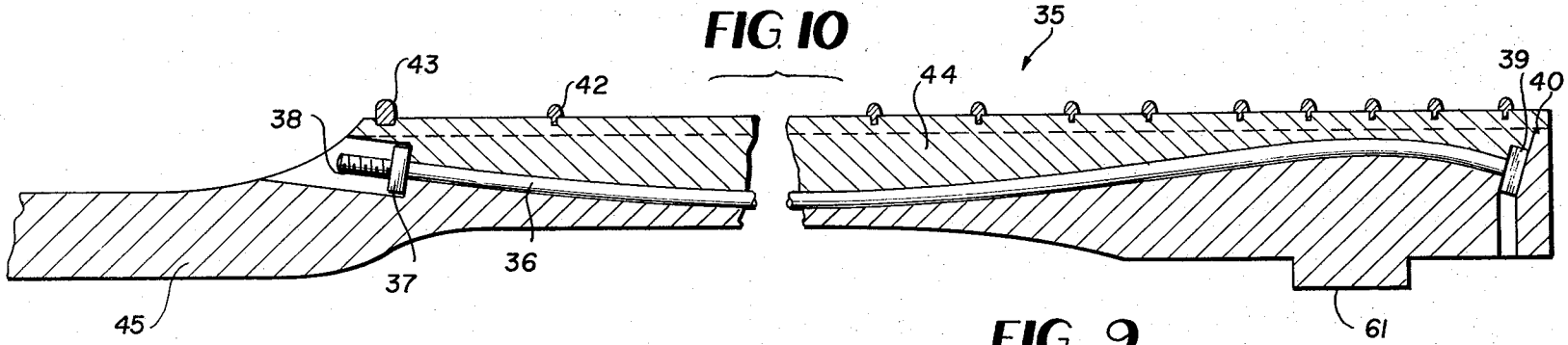
FIG. 10 is a sectional view taken along lines 10—10 of FIG. 9.

The guitar neck and its cooperation with the guitar body can now be defined. The guitar neck 35 FIG. 8 can generally be regarded as having a neck base 45 which has a central groove on its top face nearest the finger board 41 to allow placement therein of a torsion rod 36. A torsion rod is affixed at opposed extremities by a headed end 39 at one extremity and a threaded terminus 38 at the opposed extremity and with a lock washer and nut 37 disposed on the threaded end. The torsion rod has a complex curvature which bows initially away from the fret and finger board 41 and thereafter curves upwardly towards the finger board and terminates at the headed end. When a guitar neck that is made of wood is to be used, the groove to accept the torsion bar is first milled and two opposed pieces of blank stock are glued together. However when the neck is made of synthetic material, the groove or channel way can be molded integral with the neck which in one preferred form is made of glass filled polycarbonate material. Of course other materials can be used.

Traditional finger boards are made from rose wood or ebony because of the wear characteristics and the impervious nature of this wood to acid as well as providing resiliency. The groove between the torsion bar and the finger board has traditionally been filled by a wooded insert. In this way, when the strings are disposed upon the finger board and tensioned properly, the tendency of the finger board to bow in response to this tension is cancelled out by the opposing force provided by the torsion rod.

Figure 9:
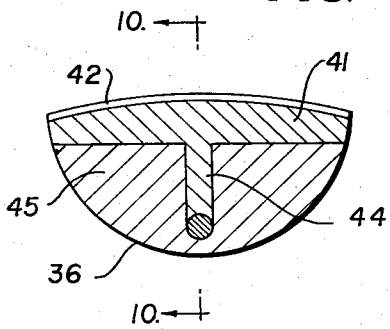
FIG. 9 is a sectional view taken along lines 9—9 of FIG. 8.
Figure 11:
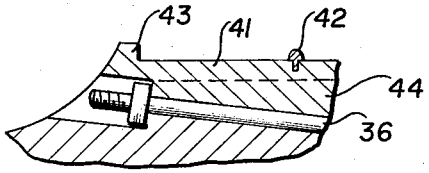
FIG. 11 is a detailed view of one end of the torsion rod where it meets a terminal point of a finger board and the guitar neck itself.
Figure 12:
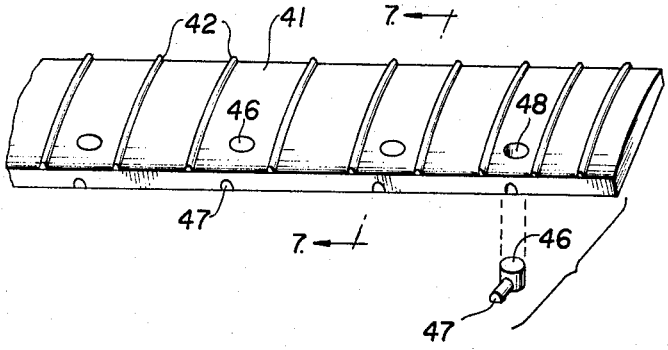
FIG. 12 details the structure associated with the finger board per se.
Figure 13:
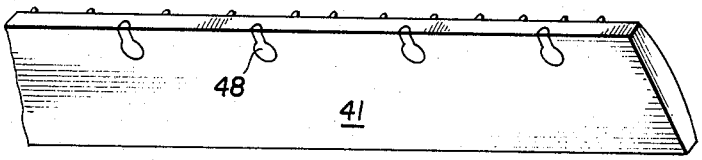
FIG. 13 is a bottom view thereof.
Figure 14:
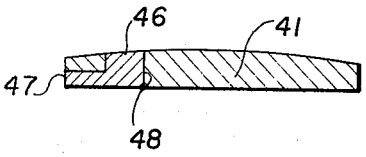
FIG. 14 is a sectional view taken along lines 14—14 of FIG. 12.
Figure 15:
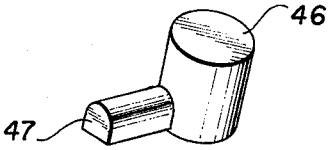
FIG. 15 is a perspective view of a position marker associated with the finger board.

The present invention provides a web 44 which extends downwardly and is integral with the plastic finger board 41 (FIG. 9) so that the reaction between the torsion rod and the finger board is instantaneous and not distorted by the interposition of a foreign material within the slot. The frets 42 can be formed integrally with the finger board or pressed in and suitably affixed with adhesive or solvent, and the left terminal portion of the finger board is provided with an integral string spacing device defined as a nut 43. As shown in cross section of FIG. 9 the finger board therefore provided with a downwardly extending rib 44 which fills the slot above the torsion rod 36, and the neck is shown to define a semicylindrical solid having a central groove for reception of the web 44. FIGS. 12, 13, 14, and 15 show the specifics of the finger board construction along with the position markers 46, 47 disposed on the top face of the finger board and one side edge thereof.

The position markers 46, 47 are comprised of a single piece of plastic material having a cylindrical portion 46 connected at a bottom extremity thereof with a semicylindrical solid 47 extending outwardly therefrom, and a finger board 41 is suitably molded to provide a complimental recess 48 for reception therein of the position markers. These position markers traditionally have had not only a ornamental configuration or appearance but also serve to orient the respective fret spacings to the musician. Other geometrical shapes for the position markers are of course possible. The area nearest the torsion head 39 is provided with a space 40 to allow adjustment between the finger board and the neck and lateral translation thereabout is possible.

Figure 16:
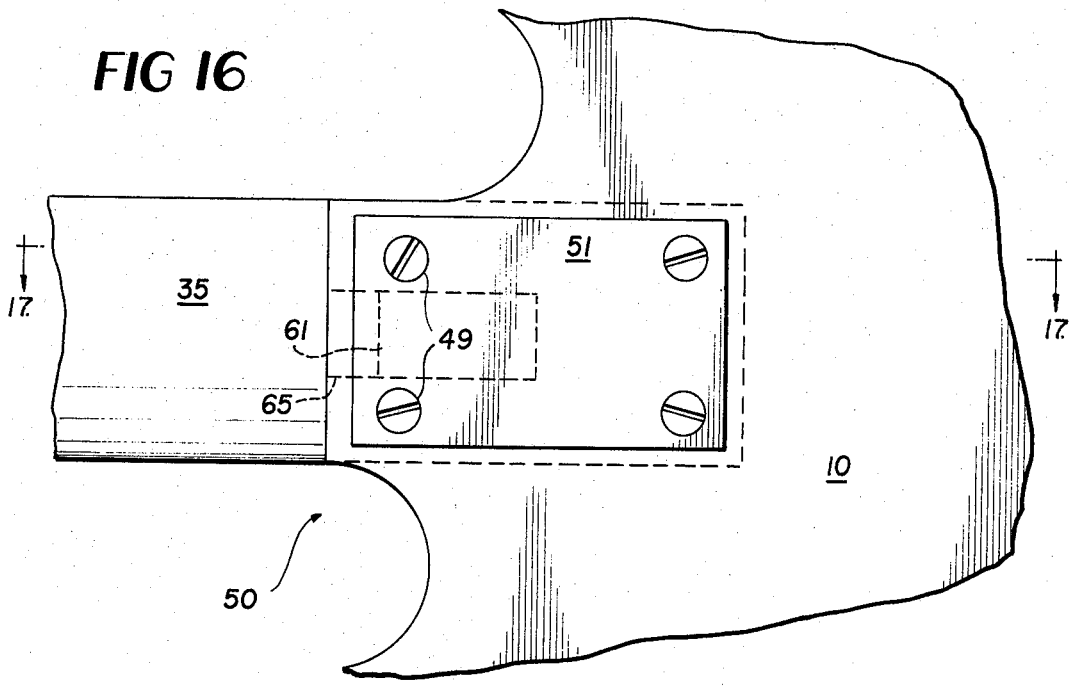
FIG. 16 is a bottom plan view of the area of interconnection between the guitar neck and body.
Figure 17:
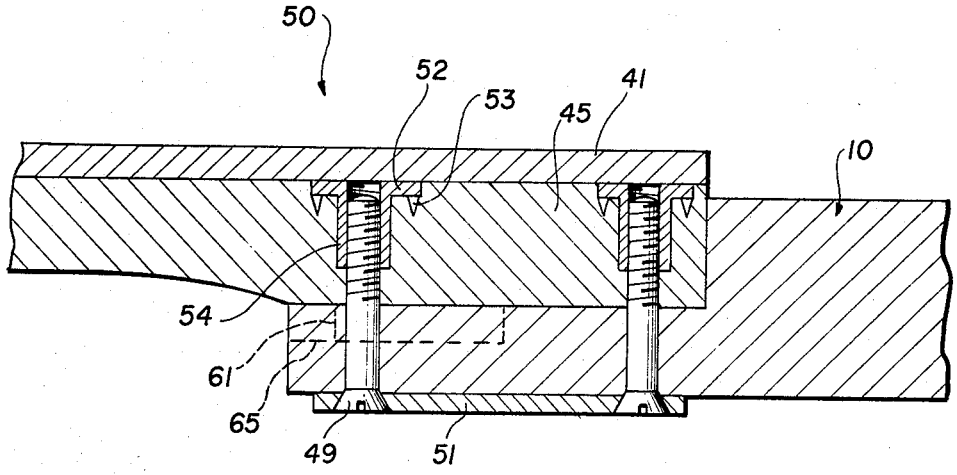
FIG. 17 is a sectional view taken along lines 17—17 of FIG. 16.

The guitar neck and body are interconnected as shown in FIGS. 16 and 17, and the body 10 and terminal portion of the neck 45 are fastened as follows. Preferrably, the neck 35 has at its terminal portion 45 been provided with a counter sunk area for the reception of T-shaped nuts 52 having downwardly extending spikes 53 and a cylindrical sleeve 54 having internal threads therein. The guitar body is correspondingly drilled so that screws 49 may be inserted therethrough and extended to and be retained by the threaded cylindrical sleeves. The screw 49 traverse through an outer plate 51 on the bottom face of the guitar which serves to distribute and dissipate the load imposed by the interconnection of these two components.

Using this technique, it should be apparent that special strictures for the use of plastic are no longer necessary, and also that the configuration described concerning the interconnection of the neck and the body provides the ability to angulate the guitar neck relative to the body by the differential in penetration that one screw enjoys over the other within the fastening area, combine with T nut 63 and set screws 64 (FIG. 1) which pivots at 65.

Another problem associated with the guitar-neck interconnection area involves the tendency of the guitar neck to rotate about the guitar body. This rotation can be defined as a deflection about the longitudinal axis of the neck when the guitar is viewed from the top or bottom. To prevent this, a key 61 is disposed on the neck which is fashioned to mate with a corresponding slot 62 as shown in FIGS. 16 and 17.

Further, it should be apparent that numerous structural modifications of this invention as set forth hereinabove and claimed hereinafter are construed as being a part of this invention within its fair meaning and scope.

What is claimed is:

1. A guitar provided with a body, a neck connected to said body, and a fingerboard disposed upon said neck, means for fastening said neck to said body, said guitar body being formed partially solid from moldable material, in which said guitar body includes a plurality of hollow areas separated by upstanding ribs, and wherein said guitar body is formed from a top and bottom section defining a clam shell type of structure, guide means are provided between said top and bottom sections to facilitate alignment of the respective portions and at least some of said hollow areas contain foam of selected densities to control the resonance of the guitar body.

2. The device of claim 1 in which said neck is provided with a central channel having varying depths disposed along its longitudinal extent, and a torsion rod is disposed therein, and said finger board comprises a top portion adapted to overlie the top of said neck, and a medially downwardly disposed web which resides within said channel in juxtaposition with said torsion rod so as to provide a link between said torsion rod and said finger board for adjusting and compensating for stresses imposed by strings on a guitar.

3. The device of claim 2 in which said finger board is provided with integral frets parallelly oriented to each other and orthogonally disposed relative to the longitudinal axis of said finger board, and further including a nut at a terminal portion thereof for orienting the strings thereover.

4. The device of claim 3 in which position markers are provided within said fingerboard through means defining openings on said finger board.

5. The device of claim 4 in which position markers are provided within said finger board through means defining openings on said finger board, and said position markers include a cylindrical solid fashioned to reside within said opening, having a semicylindrical extension disposed on a bottom edge thereof, said semicylindrical extension traversing from said finger board to an outer edge thereof.

6. The device of claim 1 in which a molding trim is disposed around an outer periphery of the guitar body along a seam between said top and bottom sections and wherein said top and bottom sections are injected molding elements.

7. The device of claim 6 in which said molding is defined by a depending flap portion which extends from said top section of the guitar body, and terminates thereafter into a stem portion, which supports a triangular wedge adapted to nest within corresponding grooves on said top and bottom sections of said guitar body so as to be affixed thereto.

8. The device of claim 7 in which said wedge coacts against a region along said bottom section of the guitar body and through a lip downwardly extending from said top section which tends to secure the bottom portion of the guitar between said wedge and said lip.

9. The device of claim 8 in which said molding is fastened to said top and bottom sections by means of an adhesive.

10. The device of claim 9 in which pockets and passageways are provided interconnected so as to provide nesting areas for electrical components disposed therein.

11. The device of claim 10 in which a cover plate is provided for one of said nesting areas.

12. The device of claim 11 wherein foams of varying density are used within said hollow areas to alter the resonance.

13. The device of claim 1 in which said means for fastening said neck to said body include a key means coacting with a slot means along an interface of said neck and body.

* * * * *